United States Patent [19]

Tedesco et al.

[11] Patent Number: 5,063,099

[45] Date of Patent: Nov. 5, 1991

[54] NON-WOVEN MAT CONSISTING OF ACRYLIC CONTINUOUS FILAMENTS SHOWING HIGH MODULUS IMPREGNATED WITH AN INORGANIC MATRIX

[75] Inventors: Raffaele Tedesco; Giampaolo Busato; Giampaolo Sinatora, all of Mestre, Italy

[73] Assignee: Montefibre S.p.A., Milan, Italy

[21] Appl. No.: 496,116

[22] Filed: Mar. 19, 1990

Related U.S. Application Data

[63] Continuation of Ser. No. 196,342, Oct. 9, 1987, abandoned.

[30] Foreign Application Priority Data

Oct. 14, 1986 [IT] Italy ..... 21990 A/86

[51] Int. Cl.[5] ..... B32B 5/12; B32B 13/00

[52] U.S. Cl. ..... 428/109; 428/105; 428/110; 428/284; 428/294; 428/297; 428/298; 428/373; 428/703; 428/902; 28/282

[58] Field of Search ..... 428/291, 284, 285, 373, 428/902, 703, 109, 105, 110, 294; 28/282

[56] References Cited

U.S. PATENT DOCUMENTS

| | | | |
|---|---|---|---|
| 2,121,285 | 6/1938 | Cone | 428/295 |
| 3,903,879 | 9/1975 | Riley et al. . | |
| 3,998,988 | 12/1976 | Shimomoi et al. | 428/373 |
| 4,076,884 | 2/1978 | Riley et al. . | |
| 4,133,928 | 1/1979 | Riley et al. . | |
| 4,284,667 | 8/1981 | Moens | 428/292 |
| 4,414,031 | 11/1983 | Studinka et al. . | |
| 4,414,262 | 11/1983 | Hartmann et al. . | |
| 4,454,184 | 6/1984 | Britton | 428/294 |
| 4,559,262 | 12/1985 | Cogswell et al. | 428/294 |
| 4,578,301 | 3/1986 | Currie et al. | 428/109 |
| 4,612,241 | 9/1986 | Howard, Jr. | 428/292 |
| 4,613,535 | 9/1986 | Harpell et al. | 428/295 |
| 4,617,229 | 10/1986 | Larsson et al. | 428/288 |
| 4,706,430 | 11/1987 | Sugita et al. | 428/292 |
| 4,713,283 | 12/1987 | Cogswell et al. | 428/292 |
| 4,748,064 | 5/1988 | Harpell et al. | 428/284 |

FOREIGN PATENT DOCUMENTS

| | | |
|---|---|---|
| 24539 | 3/1981 | European Pat. Off. . |
| 0028867 | 5/1981 | European Pat. Off. . |
| 113861 | 6/1984 | European Pat. Off. . |
| 0223291 | 5/1987 | European Pat. Off. . |
| 1900265 | 11/1970 | Fed. Rep. of Germany . |
| 3142598 | 11/1983 | Fed. Rep. of Germany . |
| 3210145 | 11/1983 | Fed. Rep. of Germany . |
| 2560116 | 9/1985 | France . |
| 7104631 | 7/1971 | Netherlands . |
| 1213441 | 11/1970 | United Kingdom . |
| WO80/0960 | 5/1980 | World Int. Prop. O. . |

*Primary Examiner*—George F. Lesmes
*Assistant Examiner*—James D. Withers
*Attorney, Agent, or Firm*—Morgan & Finnegan

[57] ABSTRACT

Non-woven mat consisting of one or more overlapped layers, each made of continuous, parallel, monodirectional filaments of an acrylic polymer having a tenacity of at least 50 cN/tex, an elastic modulus equal to at least 1000 cN/tex, and an ultimate elongation lower than 15%.

Use of this non-woven mat as reinforcement for organic and inorganic matrices, and manufactured articles thus obtained.

9 Claims, No Drawings

NON-WOVEN MAT CONSISTING OF ACRYLIC CONTINUOUS FILAMENTS SHOWING HIGH MODULUS IMPREGNATED WITH AN INORGANIC MATRIX

This application is a continuation of application Ser. No. 106,342, filed Oct. 9, 1987, now abandoned.

DISCLOSURE OF THE INVENTION

The present invention relates to a non-woven mat of acrylic continuous filaments.

More particularly, the present invention relates to a non-woven mat of continuous, parallel, monodirectional acrylic filaments having a high modulus, particularly suitable to be used as reinforcement of inorganic matrices such as for instance cement, plaster, mortar, concrete, etc. and organic matrices such as bitumen, thermosetting resins etc.

The use of acrylic fibers having high tenacity and high elastic modulus in the form of short fibers, from 30 to 60 mm, single or joined adhesively for reinforcing cement, mortar, bitumen or thermosetting resins is known.

The use of these short fibers, however, requires particular and sometimes complicated operations and apparatus for the handling and dispersion of the short fibers into the matrices to be reinforced. Furthermore, the use of short fibers for the above-mentioned applications is a limitation on the reinforcing action of the fibers, because in the points of discontinuity (necessarily existing since the short fibers are not continuous) the reinforcing contribution of these fibers is absent.

The need of an available continuous reinforcement is more keenly felt if the matrices are brittle, such as for instance in the case of cement. In this case, and in particular in the case of undulated slabs exploited as a roofing for buildings, what is required is a non-brittle and non-instantaneously breakable manufactured article (under foot action) for safety reasons.

Furthermore, in the specific case of materials to be used for civil or industrial buildings, a reinforcing element is required which, besides very good physico-chemical properties and chemical stability, has also a reasonable cost.

In fact it would be possible, starting from high modulus acrylic fibers or from other organic fibers, to produce woven mats made on the usual kind of loom; but in this case the low hourly ouput and the need of mini-tows, wound on spools, and containing a limited number of filaments (2,000–3,000), would unduly increase the cost of the finished manufactured article.

It has now been discovered, in accordance with the present invention, that a reinforcement having all the above-mentioned desirable characteristics is a non-woven mat consisting or consisting essentially of one or more overlapped layers, each consisting or consisting essentially of continuous, parallel, monodirectional filaments of an acrylic polymer having a tenacity of at least 50 cN/tex, an elastic modulus of at least 1,000 cN/tex, and an ultimate elongation lower than 15%.

The non-woven mat of the present invention has preferably a very spread-out or open structure, to allow an easy penetration of the matrix to be reinforced.

The layers which make up the non-woven mat are preferably crossing layers, thereby providing a homogeneous reinforcement along the two normal directions. The number of layers is preferably at least 2, dependent upon the stress to which the finished manufactured article will be subjected. Non-woven mats containing up to 100 overlapped and crossed layer may be used.

Each layer may have a weight from 10 to 200 g/m$^2$, and preferably between 20 and 50 g/m$^2$.

The filaments of each layer have a diameter varying from 8 to 50 micrometers and may be attached or cohered to each other either by conventional adhesive agents or by sewing.

Generally, the attaching or cohering agent is chosen according to the use for which the mat is intended so that this agent will be compatible with the matrix to be reinforced. Furthermore, in some cases it is required that this agent shall be soluble in the matrix so that the filaments will be free from each other after the matrix impregnation.

Thus, for instance, if the mat of the present invention is to be used for reinforcing inorganic matrices such as mortar, concrete, plaster, and so on, the attaching agent will be selected from those which dissolve or swell in water or in an alkaline solution of such matrices.

On the contrary, if the mat is to be used for reinforcing matrices of thermosetting resins, such as polyesters, epoxy or polyurethane resins, etc., then the attaching agent is preferably of the type soluble in organic solvents such as ethylene glycol, styrene, toluene, etc. Finally, if the mat is to be used to reinforce bitumen, then the attaching agent is preferably insoluble and not meltable under the conditions used to produce the reinforcement.

Examples of agents which dissolve or swell in water and thus may be used are carboxymethylcellulose, polyvinylalcohol, polyacrylic or polymethacrylic acids, polyvinylacetate having a medium or a high degree of hydrolysis, acrylic and/or methacrylic copolymers (either water-soluble or emulsifiable), copolymers containing an alkylacrylate, an alkylmethacrylate and an unsaturated carboxylic acid, etc.

Examples of attaching or agents soluble in organic solvents are polyurethane resins, polyester resins, epoxy resins, etc.

Examples of attaching agents insoluble and not meltable are urea-formaldehyde resins, melamine resins, grafted acrylic resins, etc.

The amount of attaching or cohesion agent to be used depends on the diameter of the filaments, the number of filaments per unit width, and on the type of the attaching agent used. Generally, such amount is between 5 and 50%, and preferably between 10 and 20% by weight, calculated on the filaments.

The attachment or cohesion of the filaments of each layer may also be obtained by sewing transversally to the filaments and at a distance or spacing of 2–15 cm. Such an expedient allows one to have a higher surface of interaction between filaments and the matrix to be reinforced, because the staples or ends of the filaments are practically all free.

The term filaments of acrylic polymer comprise those obtained by wet or dry spinning of acrylonitrile homopolymers or copolymers, containing at least 90% by weight of acrylonitrile, the remainder being an ethylenically unsaturated comonomer which may be co-polymerized with acrylonitrile, such as methylmethacrylate, methylacrylate, vinylacetate, styrene, vinyl chloride, etc. Preferably, these polymers have a specific viscosity between 0.1 and 0.6. Acrylonitrile homopolymer is particularly preferred.

According to a preferred embodiment of the invention, the non-woven mat of the present invention may be produced according to a process comprising the following steps:

(a) production by dry or wet spinning of a smooth tow of continuous stretched and collapsed (i.e., heat treated under tension) filaments;
(b) opening or spreading the tow homogeneously and with parallel staples by means of rollers and curved bars up to the desired width, generally between 50 and 500 cm;
(c) addition of a specific bonding agent (adhesive) compatible with the matrix; said bonding agent being generally applied by spraying or by dipping the spread tow in an aqueous solution or dispersion of the bonding agent; alternatively, the filaments of the tow may be sewed transversally to the movement of the tow by means of a stitcher;
(d) drying, if the bonding agent is used, in a hot-air circulation oven or in an infrared ray oven, at 80°-150° C., until the water is evaporated and the bonding agent is hardened;
(e) collection of the monodirectionally stretched layer on a spool; and
(f) optionally, crossed overlapping of more monodirectional layers.

The thus obtained non-woven mat is used for reinforcing inorganic or organic matrices of the above-mentioned type and the thus-obtained reinforced manufactured articles show low brittleness and high impact resistance besides high values of tensile strength. These last-mentioned properties cannot be obtained when using as the reinforcing material short fibers, such as asbestos, glass, or short organic fibers.

To still better understand the present invention, an illustrative and not limitative example follows hereinafter.

EXAMPLE

Production of the mat

A continuous and smooth tow consisting of 80,000 filaments, each having a section corresponding to 2.5 dtex (diameter = 16 micrometers) was produced by wet spinning an acrylonitrile homopolymer having a specific viscosity of 0.3. The tow was stretched 7 times in hot water, dried under stress at 180° C., and then dry-stretched a further 2 times, cooled and collected in boxes, avoiding any twisting. Each single filament of the tow had a tenacity of 70 cN/tex, an elastic modulus of 2,200 cN/tex, and a 9% ultimate elongation.

This tow was then continuously fed into a machine consisting of:

a series of straight bars alternated with curved bars on which the tow was spread under stress until it reached 1 meter in width;
a series of spray nozzles metering a 20% by weight aqueous solution of partially hydrolyzed (90%) polyvinylacetate, with a flow supplying a 15% content of the adhesive calculated on the fiber;
a hot-air circulation drying chamber (at 150° C.); and
a system for winding the thus-obtained layer on a spool.

The layer, consisting of continuous, parallel, monodirectional and bonded filaments, had a weight equal to 23 g/m$^2$ and such a consistency as to allow easy handling in the operations of cutting, overlapping of more layers, and impregnation in the matrix to be reinforced.

The layer was used to produce a continuous multilayer "mat", 1 meter in width, consisting of 6 overlapped layers, with a sequence of the type 00-11-00, wherein 0 means a layer having filaments parallel to the longitudinal direction of the band and 1 means a layer having filaments perpendicular to the same longitudinal direction. The edges of the thus-obtained multilayer "mat" were sewed 1 cm in width on each side to ensure good dimensional stability and easy handling of the mat.

Production of slabs

A mixture of Portland cement and water, in a 100:35 weight ratio, was prepared in a mixer. Said mixture was used for the preparation, according to different procedures, of the following three series of flat slabs A, B and C having a 25×25×0.75 cm size.

Slabs A (without the addition of any fibers or filaments): the mixture was poured into a 25×25×0.75 cm size frame and slicked or smoothed on the surface by means of a sleeker (i.e., a spatula or broad knife).

Slabs B (containing fibers 6 mm in length): polyacrylonitrile fibers (6 mm in length) were added into the mixer in an amount corresponding to 2% by weight based on the Portland cement. The mixture, after homogenization, was poured into the above-mentioned frame, vibrated and slicked on the surface by means of a sleeker. The fiber had a 2.5 dtex titer, a 70 cN/tex tenacity, a 2200 cN/tex elastic modulus, and a 9% ultimate elongation.

Slabs C (containing continuous filament mat): a portion of the cement-water mixture was poured on the bottom of the above-mentioned frames, for about 1 mm thickness. The mat obtained as above, consisting of 6 layers, crossed according to the 00-11-00 sequence and having a 25×25 cm size, was placed in the frames on the cement-water mixture.

Further cement-water mixture was added and, by the aid of a roller, the "mat" was completely impregnated with the cement-water mixture. Along the same direction, a second "mat" of the same size and type was overlapped and further cement-water mixture was poured until the thickness of 0.75 cm was reached; the whole was vibrated and slicked by means of a sleeker. The fiber content was 2%, calculated on the cement.

All three series of slabs were covered with polyethylene films, kept for 24 hours at room temperature, then dipped in water for 7 days and finally allowed to ripen at 20° C. (at 100% relative humidity) until the 28th day.

The slabs were then subjected to a flexural impact test, according to UNI 3948, and the following results were obtained:

| | Ultimate load kg/cm$^2$ | % Elongation under ultimate load | % Elongation under 25% of the ultimate load |
|---|---|---|---|
| Slabs A | 50 | 0.05 | 0.05 |
| Slabs B | 130 | 0.13 | 0.17 |
| Slabs C | 160 | 0.34 | 1.5 |

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

What is claimed is:

1. A non-woven mat impregnated with an inorganic matrix, said mat consisting of at least one layer, wherein each layer consists of a plurality of continuous parallel, monodirectional polyacrylic filaments having a tenacity of at least 50 cN/tex, an elastic modulus of at least 1,000 cN/tex, and an ultimate elongation lower than 15%, the filaments in each layer being bound together, said continuous filaments being arranged in a spread out open structure obtained by opening a tow of filaments until a width of between 50 and 500 cm prior to bonding the filaments in each layer to the other, wherein the filaments are bonded together by a cohesion agent in an amount from 5 to 50% by weight of the filaments, and the cohesion agent is a member of the group of agents which dissolve or swell in water or an alkaline solution of the matrix, employed when the non-woven mat is impregnated with the inorganic matrix to manufacture reinforced inorganic matrix.

2. An impregnated non-woven mat according to claim 1, wherein the layers are at least 2 and up to 100.

3. An impregnated non-woven mat according to claim 2, wherein the layers are crossed in such a manner as to give a reinforcement homogeneous in the two normal directions.

4. An impregnated non-woven mat according to claim 1, wherein each layer has a weight between 10 and 200 g/m$^2$.

5. An impregnated non-woven mat according to claim 1, wherein each layer has a weight between 20 and 50 g/m$^2$ wherein the filaments are from 30 to 60 mm long and the open structure is obtained by opening the tow of filaments until a width between about 100 and 500 cm.

6. An impregnated non-woven mat according to claim 1, wherein the filaments of each layer have a diameter between 8 and 50 micrometers and the cohesion agent is in an amount of from 10 to 20% by weight of the filaments.

7. Non-woven mat according to claim 1, wherein the filaments in each layer are bound together by transverse stitches at a mutual distance of 2 to 15 cm.

8. An impregnated non-woven mat according to claim 1, wherein the inorganic matrix is selected from mortar, concrete and plaster.

9. An impregnated non-woven mat according to claim 1, wherein the layers are at least 2 and up to 6.

* * * * *